US006308371B1

(12) United States Patent
Forsline

(10) Patent No.: US 6,308,371 B1
(45) **Date of Patent: *Oct. 30, 2001**

(54) SILICONE PAINT BRUSH ARTIST'S TOOL

(75) Inventor: Ladd B. Forsline, Lyons, PA (US)

(73) Assignee: Royal Sovereign Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/852,205

(22) Filed: May 9, 2001

Related U.S. Application Data

(63) Continuation of application No. 09/366,859, filed on Aug. 4, 1999, which is a continuation of application No. 08/692,716, filed on Aug. 6, 1996, now Pat. No. 6,032,322, which is a division of application No. 08/424,804, filed on Apr. 19, 1995, now Pat. No. 5,542,144.

(51) Int. Cl.[7] ..... B05C 17/00

(52) U.S. Cl. ..... 15/245.1; 15/188; 15/425; 132/320; 401/199

(58) Field of Search ..... 15/188, 244.1, 15/245, 245.1, 425, 427, 431; 401/199, 172; 118/410; 132/218, 320

(56) References Cited

U.S. PATENT DOCUMENTS 85,961 * 1/1869 Reckendorfer ..... 15/431
126,224 * 4/1872 Muller ..... 15/431
136,319 * 2/1873 Gray ..... 15/431
1,352,677 * 9/1920 Moore ..... 15/431
1,903,474 * 4/1933 Reckford ..... 15/431
2,147,310 * 2/1939 Morrison .

* cited by examiner

*Primary Examiner*—Randall E. Chin
(74) *Attorney, Agent, or Firm*—Patterson, Thuente, Skaar & Christensen, PA

(57) ABSTRACT

A silicone paint brush artist's tool includes a handle and a novel painting tip. The painting tip is made of a resilient silicone having a generally three-dimensional paint contacting working surface that has a maximum cross-sectional diameter no larger than a maximum cross-sectional diameter of the handle. The tip is preferably attached to the handle using a ferrule and expansively locking the tip into a cavity of the ferrule by insertion of an insert. The insert may be a common screw or a barbed, fluted extension of the handle. The tips may include an insert cavity and have various shapes and hardnesses and may be optionally color coded. A formation method for the tool is disclosed with simultaneous insert insertion and joining of ferrules to handles. The ferrules also may be reversibly attached to the handle, in which case a kit comprising multiple interchangeable painting tips may be provided.

36 Claims, 2 Drawing Sheets

SILICONE PAINT BRUSH ARTIST'S TOOL

This is a Continuation Divisional application under 37 C.F.R. § 1.53(b), of pending prior Application No. 09/366,859, filed Aug. 4, 1999, now pending, for: SILICONE PAINTING TIP FOR PAINT BRUSH by: Ladd B. Forsline, which is a continuation of prior Application No. 08/692,716, filed Aug. 6, 1996 for: SILICONE PAINTING TIP FOR PAINT BRUSH by: Ladd B. Forsline now issued as U.S. Pat. No. 6,032,322 which is a divisional of prior Application No. 08/424,804, filed Apr. 19, 1995 for: SILICONE PAINT BRUSH ARTIST'S TOOL by: Ladd B. Forsline, now issued as U.S. Pat. No. 5,542,144. The entire disclosure of the prior applications are considered as being part of the disclosure of the accompanying application and are hereby incorporated by reference therein.

FIELD OF THE INVENTION

The present invention relates to the field of devices for paint application and manipulation of paint upon a substrate by artists. In particular, the present invention relates to applicators and manipulators having an impermeable, paint contacting surface on their working tip, as opposed to traditional brushes having a bristled tip. The present invention also relates to a method of attaching impermeable working tips to handles to form a painting device.

BACKGROUND OF THE INVENTION

Since prehistoric times, artists have applied and manipulated paint on substrates. Very early artists might have used their bare hands and fingers, as do children and even artists today, but the use of tools for painting became common very early. Some of the earliest of such tools were likely mere sticks. However, bristled brushes have been known and in use for much of modern history. Traditionally, bristled brushes were formed from natural materials such as the hair of animals attached to a wooden handle. With the development of modern synthetic plastics, artificial bristles have become available also. Bristle tipped brushes are characterized by a tendency to draw or wick a supply of paint into the intersticial spaces between the bristles and subsequently release a portion of such paint when the bristles are applied to a substrate. This may be viewed as somewhat wasteful of paint and moreover results in a significant cleanup problem. Cleaning of a bristle brush in order to apply or manipulate a different paint color can slow down an artist and truly interrupt and impede the creative process. Further, failure to promptly and appropriately clean a brush after use often times renders the brush useless for any future use because the intersticial paint irreversibly dries within the body of the brush. The cost of good natural bristle brushes is generally rising and the cost of synthetic bristle substitutes, while often less costly than the natural variety, also is generally rising.

As an alternative to bristled brushes, artists have also used stiff, spring-like metal spatulas for application and manipulation of paint. U.S. Pat. No. 2,861,371 to Leshik discloses some exemplary steel spatulas. U.S. Pat. Nos. 2,099,030 and 2,147,310 to Morrison disclose some exemplary rubber spatulas for liquid and dry color painting, respectively. While spatula-like tools provide some advantages over traditional bristle brushes in terms of longevity and cleaning, the fact that the working portions of these tools are primarily flat, two-dimensional surface effectively limits the manner in which an artist can use these tools for applying paint to a surface to more of a trowel-like action. Consequently, artists generally regard spatula-like tools as a separate type of paint applicator with it's own limited style of marks that has a different manner in which paint is applied to a surface, rather than as a replacement for the more versatile bristle brush.

U.S. Pat. No. 3,609,051 to Braun discloses a rotatable brush having a rotatable tip made of a porous resilient material. Using the rolling application techniques of longer, conventional paint rollers for coating walls and the like, this tool provides another alternative to a conventional bristle brush. Again, because of the different manner in which this tool applies paint to a surface, artists generally would not regard this tool as a replacement for the more versatile bristle brushes. In addition, due to the porous nature of the rolling tip, this tool also has problems with cleaning and longevity of the tool.

Although alternatives to conventional bristle brushes for artists have been developed, these tools typically have a more limited range of marks and manners of applying paint to a surface that are not as versatile as bristle brushes. Consequently, these tools have generally not been regarded by artists as replacements for a conventional bristle brush in the sense that the use of these tools would replace many of the characteristic functions of the more versatile bristle brush in terms of the marks and manner in which such marks can be made, but instead these tools have been seen as alternative types of paint applicators. Accordingly, it would be desirable to provide an artist's tool that has improved longevity and cleaning characteristics, but otherwise could be accepted as an effective replacement for traditional bristle brushes.

SUMMARY OF THE INVENTION

The present invention is a silicone paint brush artist's tool that includes a handle and a novel painting tip. The painting tip is made of a resilient silicone having a generally three-dimensional paint contacting working surface that has a maximum cross-sectional diameter no larger than a maximum cross-sectional diameter of the handle. The tip is preferably attached to the handle using a ferrule and expansively locking the tip into a cavity of the ferrule by insertion of an insert. Because the painting tip has dimensional characteristics similar to those of conventional bristle brushes, the operation of the artist's tool more closely simulates that of a conventional bristle brush than does a spatula-type tool. Because the painting tip is made of a resilient, nonporous silicone, the tool is more durable and easier to clean than a conventional bristle brush. In this way, the present invention is a unique hybrid of the cleaning and longevity characteristics of spatula-type tools with the versatility and functional characteristics of a bristle-type brush.

In a first embodiment, the present invention is a device for application and manipulation of paint on a substrate. Such a device offers a paint artist many useful advantages as will be discussed subsequently. The device includes three primary components: a handle, a ferrule, and a silicone tip for contacting paint. The handle has a distal end and a proximal end. The ferrule is rigid and is attached to the distal end of the handle and projects from the distal end of the handle to define a cavity adjacent the distal end of the handle. This cavity has an interior surface which carries the tip. The tip is provided with a generally three-dimensional working surface having a maximum cross-sectional diameter that is preferably no larger than the maximum diameter of the handle. The tip is formed of a resilient silicone material and, therefore, has a paint contacting portion with a nonporous surface. The tip also has a ferrule connecting portion. The ferrule connecting portion is expanded into locking contact within the interior surface of the cavity of the ferrule. Preferably, the expansion of the ferrule connecting portion results from an insert installed within the ferrule connecting portion. In one embodiment, the insert has screw threads and most preferably may be a common screw. In another embodiment, the insert includes at least one barb, preferably a plurality of barbs, interacting with the ferrule connecting portion of the tip to resist longitudinal extraction of the insert with respect to the ferrule connecting portion of the tip. In a most preferred embodiment, the insert is an extension of a plastic handle. Preferably, the tip also includes an insert cavity, longitudinally oriented within the ferrule connecting portion of the tip. In such an embodiment, the insert has a shape generally complementary to the insert cavity and transversely oversized relative to the insert cavity so as to expand the ferrule connecting portion of the tip against the interior surface of the cavity of the ferrule. Preferably, the insert, if not threaded, has a shape which resists rotation of the insert relative to the tip. In such an embodiment, it is most preferred to also have a complementary shape in the insert cavity. For example, the insert cavity and the insert may have one or more complementary longitudinally extending flutes. Four flutes are a most particularly preferred embodiment.

One advantage of the device of the present invention is the ability to provide a variety of shapes to the artist wishing to apply or manipulate paint on a substrate. Examples include tapered round, flat chisels, cup chisels, angle chisels, and cup round. These shapes can also be provided in a range of sizes. Significantly, the selection of silicone tip material also offers a range of harder or softer tips, which provide distinctive effects on the paint. The durometer readings of useful tip materials range from about 20 Shore A durometer hardness to about 70 Shore A Hardness units. Tips of various hardness can be made even more useful to the artist by including a color indicia within the material prior to forming the tips. This aspect of the invention allows an artist rapid visual identification and selection of an appropriately hard or soft tip. In an alternative embodiment, a series of longitudinal slits are created in the working end of the tip to further enhance the wicking or carrying ability of the painting tip.

Another embodiment of the present invention is the method of forming an artist's tool for application and manipulation of paint on a substrate. The method of the present invention includes the steps of: providing a handle, providing a ferrule which when attached to the handle defines a tip carrying cavity, and providing a tip, formed of resilient, non-porous non-metallic material. The tip is provided with a generally three-dimensional working surface having a maximum cross-sectional diameter that is preferably no larger than the maximum diameter of the handle. The tip has a paint contacting portion and a ferrule connecting portion. The tip is inserted into the ferrule with the ferrule connecting portion of the tip situated in the tip carrying cavity of the ferrule and the paint contacting portion extending distally from the ,ferrule. Next, the ferrule connecting portion of the tip is expanded into locking contact within the tip carrying cavity of the ferrule by installing an insert. Finally, the method is completed by attaching the ferrule, with the tip inserted in the tip carrying cavity, to the handle.

In one embodiment of the method, the insert is a screw which is reversibly advanced into the tip to lock it into the ferrule. Such an embodiment may be part of a kit, for example, in which a variety of artist's tools can be prepared using a standardized ferrule and handle in conjunction with an array of tips which vary in shape, the size of the paint contacting portion, and/or the hardness. If the attachment of the ferrule to the handle is reversible, for example a threaded attachment, then the artist may exchange tips as desired. If the attachment of the ferrule to handle is permanent, savings in production expense result yet a high quality device may still be produced.

In another preferred embodiment of the method, the handle and insert are integral. Preferably, the handle and integral insert in such an embodiment are formed of plastic. In this embodiment, the installation of the insert into the tip occurs in conjunction with the attachment of the ferrule to the distal end of the handle. Specifically, placement of the ferrule onto the handle occurs simultaneously with installation of the insert. Crimping of a metal ferrule onto the handle may then occur. If the insert and the optional insert cavity include flutes, undesirable rotation is particularly avoided in the resulting device. Four flutes are a particularly preferred embodiment in such a method. One or more barbs also may be included to better resist extraction in a permanent attachment of the ferrule to the handle. In yet another version of this method, the tip may have the integral insert of a handle inserted first and the rigid ferrule installed subsequently.

The advantages and uses of devices of the present invention are numerous. Principally, the design and operation of the present invention more closely replicates the characteristic functions of a traditional bristle brush then existing artist's tools, and, as a result, the devices can be used as effective replacements for, rather than alternatives to, traditional bristle brushes. The devices can be used to apply paint to a substrate in a manner similar to a bristle brush in that similar hand movements are used to manipulate the tool and that the tool can "carry" paint from one location on a surface to another merely by lifting the tool off the surface. In addition to applying paint, the present invention offers additional advantages over bristle brushes in terms of the ability to manipulate paint once appled to the surface, including, spreading paint upon a substrate, blending a multiplicity of undried paints on a substrate or on a palette, moving paint across a substrate surface (much like a "squeegee") and even removing paint from a substrate before the paint dries and bonds to the substrate. In this sense, the present invention more closely simulates the functional characteristics of the human fingers when used to manipulate paint once it has been applied to a surface.

Because paint remains on the tip surface, less paint is wasted than in bristle brushes. Because bristles are absent, stray bristle marks (i.e. marks from bristles inadvertently displaced and disoriented from the main group of bristles) are not encountered.

By applying more or less pressure during paint application, an artist can acquire surprising control over the amount or depth of paint deposited upon the substrate using a device of the present invention. Surprisingly, the "touch" for adequate control of application pressure is developed quickly by a user. The appearance or "mark" left in the deposited paint can be manipulated to be similar to or different than that which is generated by a bristle brush. By employing a sharp, yet soft and flexible edged device of this invention, undried paint can be scraped off from even very soft substrates, allowing an artist's paint application errors to be corrected. If texture is desired in the marks to be created, it is possible, for example, to apply texture bumps, grooves, or the like to the paint contacting surface of the device.

Another advantage of the present invention is that, while bristle brushes tend to be quite specifically designed for the particular paint types, the devices of the present invention are useful with a wide range of paints. This, in turn, reduces the number of devices an artist needs to paint effectively, thereby saving both time and expense.

The properties of one aspect of tip shape warrants particular mention. A concave surface allows application of large quantities of paint to a small area of a substrate. The paint, may if desired, be applied directly from a paint tube to the concave surface, and thence applied to the substrate. Concave surfaces also are particularly useful to manipulate paint to and from a substrate surface. The peripheral, sharp, yet soft, edges assist during such a removal step.

The properties of another aspect of the painting tip are also unique in that a series of longitudinal slits or grooves at the working end of the painting tip can created to further enhance the ability of the painting tip to wick and carry paint without the need for any type of shoveling action. The longitudinal slits or grooves in the working end of the painting tip can also create a unique mark.

Yet another advantage is the ease of cleanup. In particular, the tip surfaces of the present invention, when formed of silicone, are easily cleaned while the paint is-still wet. Often, only a simple wiping clean of the tip surface is required. If, however, the paint dries, the flexibility of the tip, in combination with the impervious surface, tends to allow dried paint to be easily cracked and peeled off of the tip. Under similar circumstances, a bristle brush would typically be unsalvageable. The ease of cleanup has significant advantages, particularly in the case- of oil-based paints where the present invention can reduce or even eliminate the use of environmentally harmful cleaning solvents.

BRIEF DESCRIPTIONS OF THE DRAWINGS

DETAILED DESCRIPTION OF THE PREFERRED EMBODIMENTS

Comprehension of the present invention can be gained through reference to the drawings in conjunction with a through review of the following explanation. In order to facilitate a full appreciation of the invention, an overview of the preferred embodiment is initially provided. The overview is followed by more detailed explanation and some significant alternative embodiments. By "paint" herein is meant not only oil based artist's paint but also acrylic paint, watercolor paint, ink, charcoal and graphite and other such liquid, solid, emulsions, suspensions, and thixotropic substances applied to a range of substrates for artistic expression purposes.

In a first embodiment, the present invention is a device for applying and manipulating paint on a substrate. For purposes of facilitating comprehension, it may be initially thought of a substitute for the traditional well known bristle brush. However, it is easier to clean and allows novel results in use.

Figure 1:
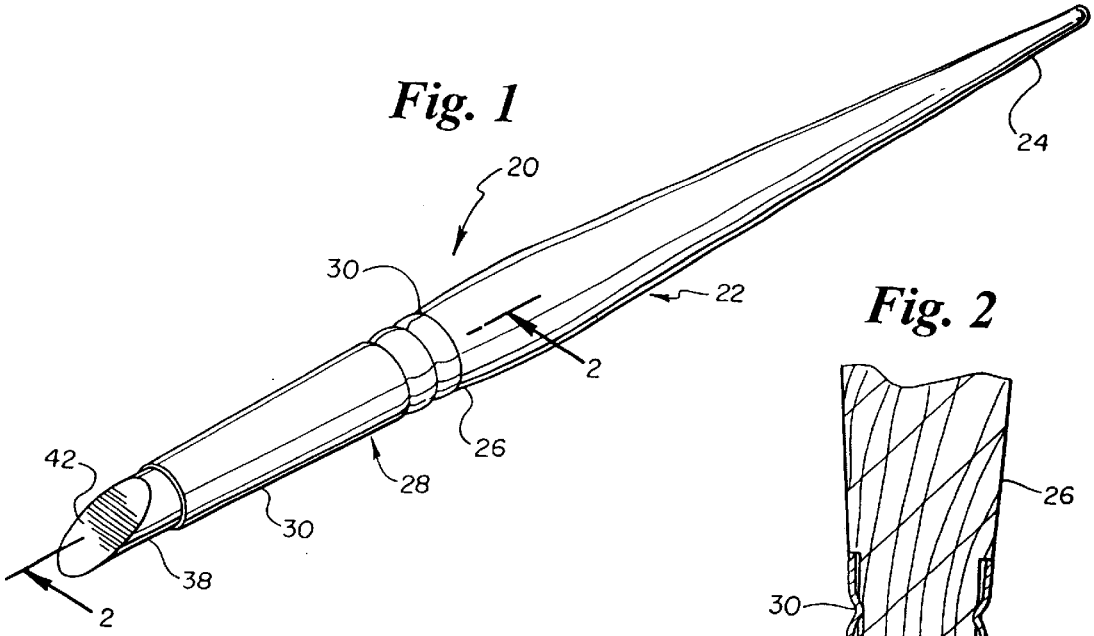
FIG. 1 is a perspective view of the paint application and manipulation device of the present invention with a flat chisel tip installed.

As shown in FIG. 1, the device 20 has a handle 22 with a proximal end 24 and a distal end 26. As will be discussed later, the handle may be formed of wood, preferably varnished or lacquered hardwood, plastic or metal.

Figure 2:
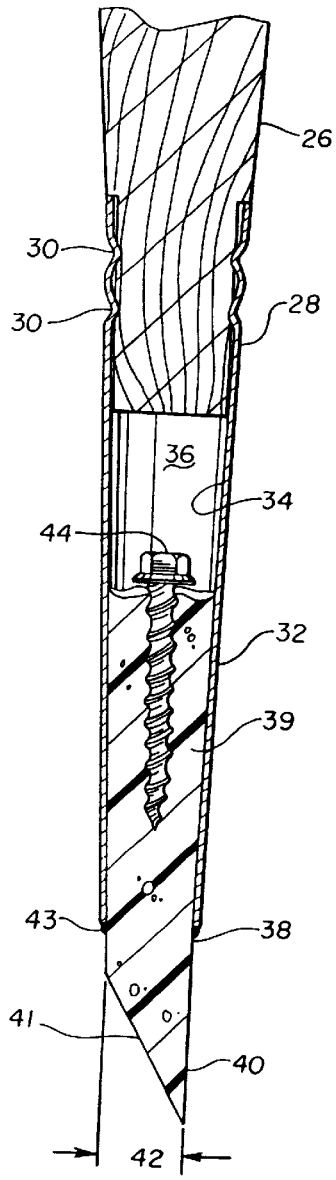
FIG. 2 is an enlarged sectional view of the device of FIG. 1 at line 2—2, with a portion of the handle omitted.
Figure 3:
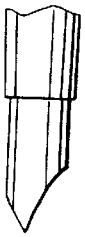
FIG. 3 is a fragmentary plan view of the device of FIG. 1 with an angle cupped chisel tip installed.
Figure 4:
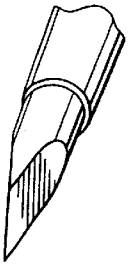
FIG. 4 is a fragmentary perspective view of the device of FIG. 1 with a flat chisel tip installed.

Attached to the distal end 26 of the handle 22 is a ferrule 28. The ferrule 28 is rigid and in a preferred embodiment may be steel, brass, copper or aluminum or a "nickel" plated brass to prevent corrosion or other suitable metallic materials. Suitable ferrules could also be formed of plastic. Preferably, the ferrule 28 is attached to the distal end 26 of the handle 22 by crimping, as represented by one or more crimps 30. The ferrule 28 preferably is tubular or barrel shaped and extends beyond the distal end 26 of the handle 22. Most preferably, the ferrule 28 is slightly tapered and is narrower in cross section at its distal end than its proximal end. The extension 32 of ferrule 28 defines a cavity 34 bounded by inner surface 36, as shown in FIG. 2. This cavity 34 lies adjacent to and extends from the distal end 26 of the handle 22.

A resilient silicone tip 38 is carried by the cavity 34. More specifically, the tip 38 has a ferrule connecting portion 39 and a paint contacting portion 40. The tip 38 is provided with a generally three-dimensional working surface 41 having a maximum cross-sectional diameter 42 that is preferably no larger than the maximum diameter of handle 22. Because the painting tip 38 has dimensional characteristics similar to those of conventional bristle brushes in that the maximum cross-sectional diameter 42 of working surface 41 is not greater than a maximum cross-sectional diameter of handle 22, the operation of the artist's tool 20 more closely simulates that of a conventional bristle brush than does a spatula-type tool which has a generally two-dimensional working surface and a width dimension of the working surface that is larger, and usually significantly larger, than the maximum cross-sectional diameter of the handle of the spatula-type tool. The fact that working surface 41 of painting tip 38 is a three-dimensional surface, rather than the two-dimensional surface of spatula-type tools, allows the present invention to place and manipulate the paint in a manner more similar to that of a bristle brush. The surface tension characteristics of the non-porous silicone material from which painting tip 38 is formed, when combined with the three-dimensional characteristics of working surface 41, allow quantities of paint to be "carried by" the painting tip 38 in manner somewhat similar to the way that paint is wicked between and carried by the bristles of a bristle brush. In contrast, if an artist desires to move paint with a spatula-type tool, the paint must be scooped onto the two-dimensional working surface of a spatula.

The tip 38 is formed of resilient silicone. The preferred silicone is characterized by low compression set (i.e. forming tips which do not substantially relax over time even under constant pressure, thus allowing maintenance of the locking relationship within the ferrule over time without the use of adhesives which might deteriorate in the presence of solvents); a high tear strength (Die B, ppi ASTM 624 method) of about 50–250 (i.e. forming tips which show little tendency to rip or tear when an artist is actively painting); hardness, after cure, of from about 20–70, and preferably from about 30 to 60, Shore A durometer hardness (ASTM 2240 method), with 25–40 Shore A durometer hardness used to form "softer" tips and 45–60 Shore A durometer hardness material used to form "firmer" tips. Most preferably, the catalyst use to cure the preferred silicone is platinum based (which provides greater solvent resistance). However, less expensive peroxide based catalyst systems are believed to be acceptable to form less demanding tips as might be appropriately supplied to children and beginning artists.

Figure 5:
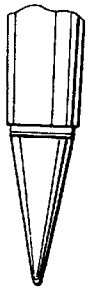
FIG. 5 is a fragmentary plan view of the device of FIG. 1 with a taper point tip installed.
Figure 6:
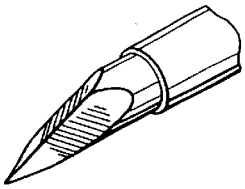
FIG. 6 is a fragmentary perspective view of the device of FIG. 1 with an angle chisel tip installed.
Figure 7:
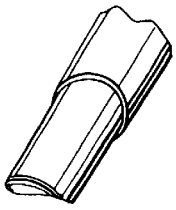
FIG. 7 is a fragmentary perspective view of the device of FIG. 1 with a cup round tip installed.
Figure 8:
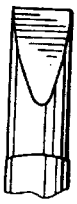
FIG. 8 is a fragmentary plan view of the device of FIG. 1 with a flat chisel tip installed.
Figure 9:
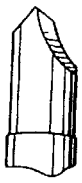
FIG. 9 is a fragmentary perspective view of the device of FIG. 1 with a cupped chisel tip installed.
Figure 10:
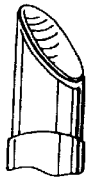
FIG. 10 is a fragmentary perspective view of the device of FIG. 1 with a cup round tip installed.
Figure 12:
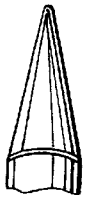
FIG. 12 is a fragmentary perspective view of the device of FIG. 1 with a taper point tip installed.

A preferred source of such material is Medical Grade Silastic ETR™ Elastomers Q7-4735 and Q7-4750 (an enhanced tear resistant silicone) available from Dow Corning, with Q7-4735 being used to form "softer" tips and Q7-4750 being used to form "firmer" tips. These products are supplied as two-part thermal-setting elastomers. A related product, Q7-4765 is arguably serviceable but results in too "firm" a tip for most painting purposes. These three products are also blendable to formulate intermediate hardnesses and Q7-4765 may be useful, for example, in such blends. It is expected that less costly commercial products having identical or nearly identical properties to Q7-4735 and Q7-4750 will be available from the manufacturer in the near future, as "medical grade" nature of these particular materials is somewhat expensive due to the additional quality control required to meet medical standards. The Q7-4535 and Q7-4750 products are represented by Dow Corning as consisting of dimethyl and methylvinyl siloxane copolymers and reinforcing silica. Other silicones which are serviceable in the production of tips, yet somewhat less desirable are: fluorosilicones (very solvent resistant but substantially more costly); general purpose silastics such as GP-50 and GP-30 from Dow Corning (sufficient strength but less solvent resistant which prevents extensive applications with oil based paints but does allow use with childrens' paints); RTV (room temperature vulcanization types) from Dow Corning; LSR (liquid silicone rubber) such as LSR 595-HC and LSR 590 (molding may be prohibitively expensive.) A notable quality of all the serviceable materials are the surface characteristics of the molded tips. Specifically, dry or drying paint does not appear to stick to the surface which results in remarkably easy cleaning of the tool tips after use. Although an unlimited variation in tip shapes is possible, the most useful shapes include the following: taper point, as shown in FIG. 5; flat chisel, as shown in FIG. 8; cupped chisel, as shown in FIG. 9; cupped round, as shown in FIG. 10; and angle chisel as shown in FIG. 6. The cup chisel, shown in FIG. 9, and cup round, as shown in FIG. 10 both include concave surfaces which artists rapidly learn to exploit to move and manipulate fresh undried paint upon a substrate surface. The tips are preferably formed by molding, such as injection-compression modling. Alternatively, the tips may be cut from cured silicone. Of course, a combination of molding and cutting may also be employed.

Referring again to FIG. 2, the ferrule connecting portion 39 is expanded within the ferrule cavity 34 to provide locking contact with the inner surface 36. This expansion is caused by an insert 44. In a preferred embodiment, the insert 44 may be a screw. The screw is installed by rotational advancement into the ferrule connecting portion 39 of the tip 38. The longitudinal movement of the insert 44 results in lateral expansion of the material of the tip 38. If the lateral expansion is sufficient, locking contact is generated between the tip 33 and the ferrule 28. Note that the expansion of the tip 38, within the ferrule connecting portion 39, is slightly more pronounced near its proximal end where the installation of the insert 44 is initiated. This effect tends to further improve the locking contact within a preferred tapered ferrule 28. Most preferably, however, a complementary taper can be provided to the ferrule connecting portion 39 of the tip 38, during tip preparation. In a preferred embodiment, tip 38 is oversized by a range of up to 5% to enhance the fit of tip 38 within ferrule 28. A raised ring 43 may be provided on tip 38 to assist in the assembly of tip 38 within ferrule 28 by indicating exactly where tip 38 should be positioned with respect to ferrule 28. During assembly, ring 43 tends to push tip 38 out slightly once tip 38 is positioned within ferrule 28 at the proper position. In one embodiment, an epoxy-based adhesive is applied to the exposed end of insert 44 to create an adhesive bond between the metal of insert 44 and the metal of an inner wall of ferrule 28 as an added security to keep insert 44 locked in position.

The insert 44 need not be a screw. Instead, locking contact can be caused by installing other suitable inserts such a nail or other hard insertable body. Optionally, the insert 44 may also include one or more barbs or rings, such as those found on flooring nails, or other devices to prevent undesired extraction and unintended unlocking of the tip 38 from the ferrule 28. Most preferably the tip 38 also includes a pilot hole, optimally axially extending from the proximal end of the ferrule connecting portion 40 and terminating at the proximal end of the paint contacting portion 42.

Although ferrule 28 and insert 44 are a preferred mechanism for attaching tip 38 to handle 22, it will be recognized that this attachment may be accomplished in other ways, such as by gluing or adhesively affixing a proximal end of tip 38 to distal end 26 of handle 22. Alternatively, a male protrusion on distal end 26 of handle 22 could be inserted into a corresponding female cavity within tip 38, or conversely a male protrusion on the proximal end of tip 38 could be inserted into a corresponding female cavity in the distal end 26 of handle 22. In either case, it would be possible to provide additional mechanical or chemical mechanisms, such as barbs, flanges, latches, screw threads, glue or adhesive, to assist in securing the tip 38 to the handle 22.

Preparation of an artist tool of the present invention also constitutes another embodiment of the present invention. Specifically, the method includes the initial steps of: providing a handle 22, such as a wooden paint bristle brush handle; providing a ferrule 28, generally such as those used on a bristle brush or a common pencil,; and providing a tip 38 or any of the variety of tip shapes and hardnesses discussed above. Next, the tip 38 is inserted into the ferrule 28 with the ferrule connecting portion 39 of the tip 38 situated in the tip carrying cavity 34 of the ferrule 28 and the paint contacting portion 40 extending distally from the ferrule 28. Then, the ferrule connecting portion 39 of the tip 38 is expanded into locking contact within the tip carrying cavity 34 of the ferrule 28 by installing an insert 44 into the ferrule connecting portion 39 of the tip 38. Preferably, a pilot hole is provided in the tip 38. A preferred pilot hole or insert cavity is undersized relative to the insert 44 but served to facilitate installation. That is, screws, by way of example, have a tendency to wander during installation and a more uniform locking contact tends to be generated by installation of the insert 44 generally axially, longitudinally, and from proximally toward distally within the ferrule connecting portion 39. If a screw is used for the insert 44, providing driving rotation to the screw within a ferrule maybe accomplished by a nut driver or a screw driver. Finally, the ferrule 28 is attached to the handle 22. If the device is to be permanent, a crimp 30 attachment may be employed. Crimp attachments can be improved and positively located by providing an encircling groove appropriately adjacent the distal end of the handle 22.

The present invention offers the possibility of interchangeably of the tips 38 if a reversible attachment, such as a female threaded ferrule and a male threaded handle are provided. In such an arrangement, an artist can be provided with a reduced quantity of handles and an array of tips 38. The tips 38 may be interchanged in a reduced quantity of ferrules, or in the alternative, each tip may have a dedicated ferrule and the tips with dedicated ferrules interchanged on a reduced quantity of handles. In such systems, an array of tips may be provided for an artist, either interchangeable separate tip, tips with dedicated ferrules, or complete artist's tools. Although an artist may readily recognize the various shapes available for employment, efficiency is enhanced by providing an inert distinct color indicia to signify the different hardnesses of the available tips. Such color indicia can be mixed with the tip material prior to molding to easily achieve this result.

In yet another alternative, the present invention allows for simple repair of a damaged artist's tool by replacement of either a tip or a tip and dedicated ferrule combination.

Figure 13:
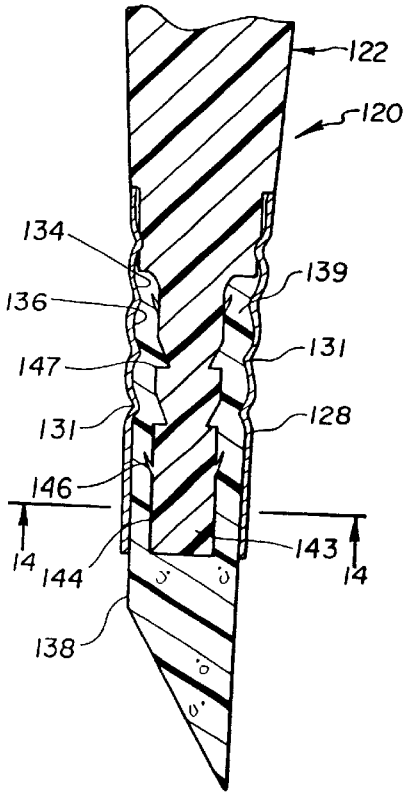
FIG. 13 is a fragmentary sectional view of an alternative embodiment.
Figure 11:
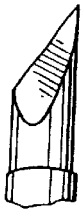
FIG. 11 is a fragmentary perspective view of the device of FIG. 1 with an angle chisel tip installed.

In a most preferred embodiment 120 of FIG. 13, an integral insert 144 extends from and is integral with a handle 122. Preferably, the integral insert 144 and the handle 122 are formed of molded thermoplastic plastic material, although they could be formed from metal or wood. The integral insert 144 includes a flute 145, most preferably four radially projecting flutes 145. These flutes 145 serve to reduce or prevent rotation of the tip 138 relative to the insert 144. Additionally, barbs 146 are present to inhibit inadvertent separation of the tip 138 from the integral insert 144. Elbows 147 on the flutes 145 similarly contribute to preventing expulsion of the integral insert 144. Further, it should be pointed out that the ferrule 128 may be crimped, for example at crimps 131 to further tighten the locking of the ferrule 128 to the tip 138.

Preferably, a pilot hole or insert cavity 143 is provided in the tip 138. The preferred insert cavity 143 is longitudinally oriented within the ferrule connecting portion 139 of the tip 138. Most preferably, the integral insert 144 and the insert cavity 143 have shapes generally complementary to each other while the integral insert 144 is transversely oversized relative to the insert cavity 143 so as to expand the ferrule connecting portion 140 of the tip 138 against the interior surface 136 of the cavity 134 of the ferrule 128.

The highly desirable quality of embodiment 120 maybe understood when considered as a permanent assembly with multiply redundant attachment systems between the tip 138 to the handle 122. That is, the tip 138 is held firmly in a number of ways. First, it is locked against the inner surface of the ferrule 128 due to outward expansion, thereby preventing both separation or rotation. Second, barbs 146 and elbows 147 also prevent longitudinal movement subsequent to installation of integral insert 144 and contribute to preventing rotation. Third, the ferrule 128 is crimped to both the handle 122 and the tip 138. Finally, flutes 145 inhibit rotation. The only remaining significant limitation of this permanent device is the structural quality of the material forming the tip 138.

The multiply redundant attachments become even more remarkable in light of another embodiment of the present invention, a method of forming an artist's tool such as that depicted in FIG. 13. The handles 122 are first provided. It is well within the skill of the art to form such handles 122 with integral inserts 144 by injection molding. Similarly, ferrules 128 can be prepared from thin metal tubing, and optionally, worked to provide a slight taper by techniques well within the skill of the art. Tips 138 of varying shapes and hardnesses can also be molded and or cut from commercial silicone materials previously mentioned. With the tip 138 inserted in the ferrule 132, the integral insert 144 and handle 122 are longitudinally installed in the insert cavity 143 and the proximal portion 132 of the ferrule 128, respectively. Finally, the ferrule 128 is attached to the distal end of the handle 122. Preferably, the attachment is by crimping and most preferably may be accompanied by crimping the ferrule 128 to the tip 138 as well.

In another method of this invention, the integral insert 144 can be first installed in the tip 138 and the ferrule 128 subsequently forced into place and crimped.

Figure 14:
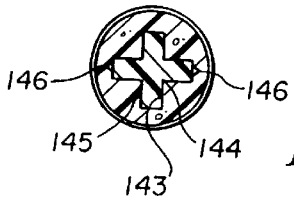
FIG. 14 is another sectional view of the alternative embodiment shown in FIG. 13.
Figure 15:
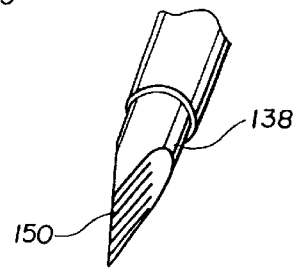
FIG. 15 is a fragmentary perspective view of an alternative embodiment of the device shown in FIG. 4.

In an alternative embodiment shown in FIG. 14, a series of longitudinal slits 150 can be created in tip 138 to enhance the wicking and paint carrying capability of the present invention. The depths of slits 150 can be cut entirely through tip 138, or only part way throught tip 138. Similarly, the length of slits 150 can be any desired length relative to the length of tip 138. It is also possible to create a pair of complementary sets of slits, one on each side of tip 138 and leave a center, non-sliced portion therebetween. In addition to creating slits 150 by cutting or slicing tip 138, it is also possible to remove a portion of the material of tip 138 to create each slit 150. The paint wicking and carrying capability is enhanced due to the mechanical nature of slits 150 and due to the increased surface area of tip 138 on which the paint can be carried. Slits 150 can also be used to create a different type of mark or stroke with the present invention.

In conclusion, it can be readily recognized that the present invention, in a number of embodiments provides a new artist tool, a method suitable for large scale economical production of a durable artist's tool or for interchangeable tips from an array of tips.

Because numerous modifications may be made of this invention without departing from the spirit thereof, the scope of the invention is not to be limited to the single embodiment illustrated and described. Rather, the scope of the invention is to be determined by appended claims and their equivalents.

What is claimed is:

1. A device for application and manipulation of paint on a substrate, comprising:

a handle having a distal end and a proximal end;

a rigid ferrule attached to the distal end of the handle and projecting from the distal end of the handle to define a cavity adjacent the distal end of the handle, the cavity having an interior surface;

a tip, formed of a resilient, non-porous non-metallic material, the tip having a paint contacting portion with a nonporous surface and a ferrule connecting portion; and means for expanding the ferrule connecting portion of the tip into locking contact within the interior surface of the cavity of the rigid ferrule.

2. The device of claim 1 wherein the means for expanding the ferrule connecting portion of the tip include an insert installed within the ferrule connecting portion.

3. The device of claim 2 wherein the insert includes screw threads.

4. The device of claim 2 wherein the insert includes at least one barb, the barb interacting with the ferrule connecting portion of the tip to resist longitudinal extraction of the insert with respect to the ferrule connecting portion of the tip.

5. The device of claim 1 wherein the handle is formed of a material selected from the group consisting of: plastic, metal or wood.

6. The device of claim 2 wherein the insert is attached to the distal end of the handle.

7. The device of claim 2 and further including:

an insert cavity, longitudinally oriented within the ferrule connecting portion of the tip;

and wherein the insert has a shape generally complementary to the insert cavity and transversely oversized relative to the insert cavity so as to expand the ferrule connecting portion of the tip against the interior surface of the cavity of the ferrule.

8. The device of claim 7 wherein the insert is an integral extension of the handle and wherein the shape of the insert and the insert cavity together resist rotation of insert relative to the tip.

9. The device of claim 8 wherein the handle and insert are plastic and the shape of the insert and insert cavity include at least one longitudinally extending flute.

10. The device of claim 1 wherein the tip includes at least one longitudinal slit.

11. The device of claim 1 wherein the tip has a durometer hardness value of from about 20 Shore A to about 70 Shore A.

12. The device of claim 1 wherein the tip has a high tear strength value of about 50–250 Die B.

13. The device of claim 1 wherein the tip has a low compression set.

14. The device of claim 11 wherein the tip material includes an indicia color conveying visual information concerning the hardness of the tip material.

15. The device of claim 1 wherein the tip has a generally three-dimensional working surface.

16. The device of claim 15 wherein the working surface has a shape selected from the set consisting of: a taper point, a flat chisel, a cup chisel, a cup round and an angle chisel.

17. The device of claim 1 wherein the tip is comprised of silicone.

18. A device for application and manipulation of paint on a substrate, comprising;

a handle having a distal end and a proximal end;

a rigid ferrule attached to the distal end of the handle and projecting from the distal end of the handle to define a cavity adjacent the distal end of the handle, the cavity having an interior surface;

a tip, formed of a resilient, non-porous non-metallic material, the tip having a paint contacting portion with a nonporous surface and a ferrule connecting portion; and an insert installed within a longitudinal end of the ferrule connecting portion of the tip to secure the tip within the interior surface of the cavity of the rigid ferrule by expanding the tip against the interior surface of the cavity.

19. The device of claim 18 wherein the tip has a durometer hardness value of from about 20 Shore A to about 70 Shore A.

20. The device of claim 19 wherein the tip has a durometer hardness value of from about 40 Shore A to about 60 Shore A.

21. The device of claim 18 wherein the tip has a high tear strength value of about 50–250 Die B and a low compression set.

22. The device of claim 18 wherein the tip is comprised of silicone.

23. A device for application and manipulation of paint on a substrate, comprising:

a handle having a distal end and a proximal end;

a rigid ferrule attached to the distal end of the handle and projecting from the distal end of the handle to define a cavity adjacent the distal end of the handle, the cavity having an interior surface;

a tip, formed of a resilient, non-porous non-metallic material, the tip having a paint contacting portion with a nonporous surface and a ferrule connecting portion; and a threaded screw installed within the ferrule connecting portion of the tip to secure the tip within the interior surface of the cavity of the rigid ferrule.

24. A device for application and manipulation of paint on a substrate, comprising:

a handle having a distal end and a proximal end;

a rigid ferrule attached to the distal end of the handle and projecting from the distal end of the handle to define a cavity adjacent the distal end of the handle, the cavity having an interior surface;

a tip, formed of resilient elastomer, the tip having a paint contacting portion with a nonporous surface and a ferrule connecting portion; and means for expanding the ferrule connecting portion of the tip into locking contact within the interior surface of the cavity of the rigid ferrule.

25. The device of claim 24 wherein the means for expanding the ferrule comprises an insert installed within the ferrule connecting portion of the tip to secure the tip within the interior surface of the cavity of the rigid ferrule.

26. The device of claim 25 wherein the insert is a threaded screw.

27. The device of claim 24 wherein the tip has a durometer hardness value of from about 20 Shore A to about 70 Shore A.

28. The device of claim 27 wherein the tip has a durometer hardness value of from about 40 Shore A to about 60 Shore A.

29. The device of claim 24 wherein the tip has a high tear strength value of about 50–250 Die B and a low compression set.

30. The device of claim 24 wherein the tip is comprised of silicone.

31. A device for application and manipulation of paint on a substrate, comprising:

a handle having a distal end and a proximal end;

a rigid ferrule attached to the distal end of the handle and projecting from the distal end of the handle to define a cavity adjacent the distal end of the handle, the cavity having an interior surface;

a tip, formed of a resilient elastomer, the tip having a paint contacting portion with a nonporous surface and a ferrule connecting portion; and an insert at least partially installed within an interior portion of the ferrule connecting portion of the tip to secure the tip within the interior surface of the cavity of the rigid ferrule by expanding the tip against the interior surface of the cavity.

32. The device of claim 31 wherein the tip has a durometer hardness value of from about 20 Shore A to about 70 Shore A.

33. The device of claim 32 wherein the tip has a durometer hardness value of from about 40 Shore A to about 60 Shore A.

34. The device of claim 31 wherein the tip has a high tear strength value of about 50–250 Die B and a low compression set.

35. The device of claim 31 wherein the tip is comprised of silicone.

36. A device for application and manipulation of paint on a substrate, comprising:

a handle having a distal end and a proximal end;

a rigid ferrule attached to the distal end of the handle and projecting from the distal end of the handle to define a cavity adjacent the distal end of the handle, the cavity having an interior surface;

a tip, formed of a resilient elastomer, the tip having a paint contacting portion with a nonporous surface and a ferrule connecting portion; and a threaded screw installed within the ferrule connecting portion of the tip to secure the tip within the interior surface of the cavity of the rigid ferrule.

* * * * *

UNITED STATES PATENT AND TRADEMARK OFFICE

CERTIFICATE OF CORRECTION

PATENT NO. : 6,308,371 B1
DATED : October 30, 2001
INVENTOR(S) : Ladd B. Forsline It is certified that error appears in the above-identified patent and that said Letters Patent is hereby corrected as shown below:

Title page, Item [54] and Column 1, line 1,
The title, should be: -- APPLICATOR HAVING RESILIENT TIP --.

Column 1,
Line 65, please change "surface" to -- surfaces --.

Column 5,
Line 15, please change to read -- can be created… --.
Line 22, please delete the "-" between "is still".
Line 29, please delete the "-" from the word "case".

Column 6,
Line 6, please change "through" to -- thorough --.
Line 19, please change to read -- "of as a substitute… --.
Line 65, please change to read -- tip 38 in a manner… --.

Column 7,
Line 18, please change "use" to -- used --.
Line 65, please change "modling" to -- molding --.

Column 8,
Line 31, please change to read -- inserts such as a nail… --.
Line 57, please delete the "," following "pencil".

Column 9,
Line 8, please change from "maybe" to -- may be --.
Lines 16-17, please change "interchangeably" to -- interchanging --.
Line 25, please change to read -- separate tips, tips with… --.
Line 60, please change "maybe" to -- may be --.

UNITED STATES PATENT AND TRADEMARK OFFICE

CERTIFICATE OF CORRECTION

PATENT NO. : 6,308,371 B1
DATED : October 30, 2001
INVENTOR(S) : Ladd B. Forsline It is certified that error appears in the above-identified patent and that said Letters Patent is hereby corrected as shown below:

Column 10,
Line 33, please change "throught" to -- through --.

Signed and Sealed this

Twelfth Day of August, 2003

JAMES E. ROGAN
*Director of the United States Patent and Trademark Office*